US011623841B2

(12) United States Patent
Tutat et al.

(10) Patent No.: US 11,623,841 B2
(45) Date of Patent: Apr. 11, 2023

(54) ELEVATOR SAFETY SYSTEM, ELEVATOR SYSTEM AND METHOD OF OPERATING AN ELEVATOR SYSTEM

(71) Applicant: Otis Elevator Company, Farmington, CT (US)

(72) Inventors: Andreas Tutat, Berlin (DE); Helge Krambeck, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 1184 days.

(21) Appl. No.: 16/190,440

(22) Filed: Nov. 14, 2018

(65) Prior Publication Data

US 2019/0168995 A1 Jun. 6, 2019

(30) Foreign Application Priority Data

Dec. 1, 2017 (EP) ..... 17204915

(51) Int. Cl.
*B66B 5/00* (2006.01)
*B66B 1/34* (2006.01)
*B66B 13/22* (2006.01)

(52) U.S. Cl.
CPC ..... *B66B 5/0031* (2013.01); *B66B 1/3453* (2013.01); *B66B 13/22* (2013.01)

(58) Field of Classification Search
CPC ..... B66B 5/0031; B66B 1/3453; B66B 13/22; B66B 1/06; B66B 1/3492
See application file for complete search history.

(56) References Cited

U.S. PATENT DOCUMENTS 4,872,532 A 10/1989 Tobita et al.
4,958,707 A 9/1990 Yoneda et al.
6,173,814 B1 1/2001 Herkel et al.
(Continued)

FOREIGN PATENT DOCUMENTS

CN 1136529 A 11/1996
CN 204737523 U 11/2015
(Continued)

OTHER PUBLICATIONS

European Search Report for application EP 17204915.7, dated Jul. 18, 2018, 7 pages.
(Continued)

*Primary Examiner* — Jeffrey Donels
(74) *Attorney, Agent, or Firm* — Cantor Colburn LLP

(57) ABSTRACT

An elevator safety system comprises a plurality of door safety units, each door safety unit; a communication bus connecting the plurality of door safety units; a control unit connected to the communication bus for allowing communication between the plurality of door safety units and the control unit; and at least one position sensor configured for providing information about the current position of an elevator car within a hoistway. Each door safety unit is assigned to an elevator hoistway door and configured for monitoring a condition of the assigned elevator hoistway door. The control unit is configured for polling door safety units included in a subset S1, S2) of the door safety units which are located within a predetermined distance (D1, D2) from the current position of the elevator car.

18 Claims, 2 Drawing Sheets

(56) References Cited

U.S. PATENT DOCUMENTS

| | | | | |
|---|---|---|---|---|
| 6,467,585 | B1 * | 10/2002 | Gozzo | B66B 13/22 187/247 |
| 6,854,566 | B2 | 2/2005 | Sweet et al. | |
| 7,194,415 | B2 | 3/2007 | Hamada | |
| 7,325,657 | B2 | 2/2008 | Angst | |
| 7,500,650 | B2 | 3/2009 | Deplazes et al. | |
| 8,225,908 | B1 | 7/2012 | Schmutter | |
| 2004/0173410 | A1 | 9/2004 | Deplazes et al. | |
| 2004/0178024 | A1 | 9/2004 | Deplazes et al. | |
| 2005/0082121 | A1 | 4/2005 | Deplazes | |
| 2017/0166418 | A1 | 6/2017 | Vakkamaki et al. | |

FOREIGN PATENT DOCUMENTS

| | | | |
|---|---|---|---|
| CN | 106429681 | A | 2/2017 |
| EP | 1151952 | B1 | 3/2005 |

OTHER PUBLICATIONS

Owen, Robert, "Mitsubishi Lift support with E-LIP—Sensor Access Technology", available at: https://sensoraccess-gpp.zendesk.com/hc/en-us/articles/115000591632-Mitsubishi-Lift-support-with-E-LIP, accessed Nov. 13, 2018, 6 pages.

David, D. J., "Microprocessor Systems", Advances in Electronics and Electron Physics, vol. 57, 1981, University of Paris, 411 pages.

* cited by examiner

ELEVATOR SAFETY SYSTEM, ELEVATOR SYSTEM AND METHOD OF OPERATING AN ELEVATOR SYSTEM

The invention relates to an elevator safety system, an elevator system comprising an elevator safety system and to a method of operating an elevator safety system.

Traditionally, elevator systems comprise hoistway door contacts, which are configured for monitoring the movement of the elevator hoistway doors (landing doors). The hoistway door contacts are serially connected with each other forming a daisy chain. The daisy chain is a part of an elevator safety chain. Any malfunction of an elevator hoistway door or an elevator hoistway door contact interrupts the daisy chain/safety chain. This results in stopping any further movement of the elevator car. As all hoistway door contacts are connected serially with each other, the diagnostic information, which is available after the safety chain has been interrupted, is very poor. It in particular does not allow locating the door contact interrupting the daisy chain. Thus, in this kind of elevator systems, identifying a faulty elevator hoistway door or elevator hoistway door contact is time consuming.

More modern safety systems employ door safety units monitoring the elevator hoistway doors. The door safety units are connected to a communication bus and are periodically polled by a control unit of the elevator system. While such systems principally allow easily identifying the door safety unit detecting a malfunction of an elevator hoistway door, the amount of data communicated via the communication bus may be large, in particular in case of high rise elevator systems comprising a large number of elevator hoistway doors. In this case, an expensive high performance communication bus is necessary in order to avoid undesirable delays which may deteriorate the safety of the elevator system.

It therefore would be beneficial to provide an improved elevator safety system which allows reducing the amount of data communicated via the communication bus without deteriorating the safety of the elevator system.

According to an exemplary embodiment of the invention, an elevator safety system comprises a plurality of door safety units, a communication bus connecting the plurality of door safety units, a control unit connected to the communication bus for allowing communication between the plurality of door safety units and the control unit, and at least one position sensor configured for providing information about the current position of an elevator car within a hoistway.

Each door safety unit is assigned to an elevator hoistway door and configured for monitoring a condition of the assigned elevator hoistway door. The control unit is configured for polling door safety units included in a subset of door safety units. The subset includes the door safety units located within a predetermined distance from the current position of the elevator car. The control unit is further configured for polling the door safety units which are not included in said subset less frequently than the door safety units included in said subset. Alternatively, the control unit is configured for polling the door safety units which are not included in said subset not at all.

The predetermined distance may be set by the control unit. The control unit may be configured for selecting the door safety units included in the subset according to the current position of the elevator car and the predetermined distance. The predetermined distance in particular may be set as a function of the speed of the elevator car.

The control unit may be a separate control unit. Alternatively, the control unit may be integrated with one of the door safety units.

Exemplary embodiments of the invention include a method of operating an elevator safety system according to an exemplary embodiment of the invention, wherein the method includes polling door safety units included in a subset of door safety units which are located within a predetermined distance from the current position of the elevator car and polling the door safety units which are not included in said subset less frequently or not at all.

Exemplary embodiments of the invention further include an elevator system comprising a hoistway extending between a plurality of landings and having a plurality of elevator hoistway doors, an elevator car configured for moving along the hoistway between the plurality of landings, and an elevator safety system according to an exemplary embodiment of the invention.

By polling the door safety units which are not located within a predetermined distance from the current position of the elevator car less frequently or not at all, the traffic (load) on the communication bus may be considerably reduced.

Since the elevator hoistway doors next to the current position of the elevator car are most crucial for the safety of the elevator system, the safety of the elevator system is maintained even if the polled door safety units are reduced to a subset of door safety units located within a predetermined distance from the current position of the elevator car.

A number of optional features are set out in the following. These features may be realized in particular embodiments, alone or in combination with any of the other features.

The control unit may be configured for periodically polling the door safety units included in the subset of door safety units. The control unit in particular may be configured for polling the door safety units included in the subset of door safety units with a frequency of 10 Hz to 30 Hz, more particularly with a frequency of 20 Hz. A polling frequency in the range of 10 Hz to 30 Hz provides a good compromise between increasing the safety of the elevator system and reducing the traffic on the communication bus.

For reducing the traffic on the communication bus even further, the control unit may be configured for polling the door safety units included in the subset of door safety units exclusively, i.e. for not polling the more distant door safety units which are not included in the subset of door safety units. By exclusively polling the door safety units located within a predetermined distance from the current position of the elevator car, the number of polled door safety units becomes independent of the height of the hoistway and the number of landings. As a result, the traffic on the communication bus is restricted to an upper limit which depends on the predetermined distance but not on the height of the hoistway.

Alternatively, the control unit may be configured for polling the door safety units not included in the subset less frequently than the door safety units included in the subset of door safety units in order to reduce the traffic on the communication bus even further while still polling all door safety units.

The control unit in particular may be configured for polling the door safety units included in the subset of door safety units with a first frequency and for polling door safety units which are not included in the subset with a second frequency which is lower than the first frequency.

In order to reduce the traffic on the communication bus even further, the control unit may be configured for polling door safety units included in a first subset, which are located within a first predetermined distance from the current position of the elevator car, more frequently than door safety units included in a second subset, which are located between the first predetermined distance and a second predetermined distance from the current position of the elevator car, wherein the second predetermined distance is larger than the first predetermined distance. The control unit further may be configured for not polling any door safety units not included in any of the subsets.

The control unit in particular may be configured for polling the door safety units included in the first subset with a first frequency and for polling the door safety included in the second subset with a second frequency which is lower than the first frequency.

The predetermined distance may be selected such as to include a predetermined number of landings ahead of and/or behind the current position of the elevator car. The predetermined number of landings in particular may be any of two, three, four or five or even more landings ahead and/or behind the current position of the elevator car. The elevator hoistway doors in this area are most crucial for the safety of the elevator system. Thus, these elevator hoistway doors may be monitored with a higher frequency than elevator hoistway doors which are more distant from the elevator car.

The predetermined distance may depend on the speed of the elevator car. In particular, the number of monitored elevator hoistway doors, in particular the number of monitored elevator hoistway doors ahead of the elevator car, may be increased in case the speed of the elevator car is increased. On the other hand, the number of monitored elevator hoistway doors may be reduced for reducing the traffic on the communication bus in case the elevator car moves more slowly.

The elevator safety system in particular may comprise a speed sensor which is configured for detecting the speed of movement of the elevator car. The speed sensor may be mounted to the elevator car. Alternatively or additionally, the speed of the elevator car may be determined from an acceleration sensor attached to the elevator car, from the positional information provided by the at least one position sensor and/or from a drive unit driving the elevator car.

The elevator safety system may be configured for determining a direction of movement of the elevator car, and the control unit may be configured for polling more door safety units located ahead of the elevator car than door safety units located behind of the elevator car. As the elevator hoistway doors located ahead of the elevator car are more crucial for the safety of the elevator system than elevator hoistway doors located behind the elevator car, polling less door safety units behind the elevator car allows reducing the traffic on the communication bus without considerably deteriorating the safety of the elevator system. In particular, only door safety units located ahead of the elevator car and no door safety units located behind the elevator car may be polled.

The elevator safety system may comprise a sensor which is configured for determining a direction of movement of the elevator car. Alternatively, the direction of movement of the elevator car may be determined from information provided by a speed sensor, by the at least one position sensor or by the drive unit driving the elevator car.

The door safety units may be configured for sending an alarm signal via the communication bus in case a predetermined event, such as an open door, is detected. The door safety units in particular may be configured for sending an alarm signal via the communication bus in case a predetermined event is detected even if the respective door safety unit is currently not polled. This enhances the safety of the elevator system even further, as events detected by door safety units, which are currently not polled, are signaled to the control unit, too.

Each of the door safety units may be a bus node, in particular a node of a field bus, particularly a CAN bus. This allows transmitting information from the door safety units via the communication bus. A field bus/CAN bus is well suited to fulfill the requirements of a communication bus in an elevator safety system according to exemplary embodiments of the invention. Other field bus systems, as they are known and used in the art, may be used as well.

In order to ensure the safety of the elevator system, in particular in order to avoid accidents caused by open doors which are supposed to be closed, the control unit may be configured for stopping any movement of the elevator car in case an alarm signal is transmitted via the communication bus and/or a polled door safety unit does not respond to the polling request within a predetermined period of time.

The position sensor may comprise a car component attached to the elevator car and/or a hoistway component attached to the hoistway. The car component in particular may include a speed sensor and/or an acceleration sensor, and it may be configured for determining the current position of the elevator car within the hoistway by integrating the detected speed and/or acceleration of the elevator car.

The car component may be configured for detecting hoistway components (markers) attached to a wall of the hoistway for determining the current position of the elevator car within the hoistway.

The position sensor may be an absolute position sensor or an incremental position sensor which is configured for detecting and summing up relative movements of the elevator car. The position sensor also may be a combination of an absolute position sensor and an incremental position sensor. With such a combination the current position of the elevator car may be continuously determined by the incremental position sensor. For maintaining the accuracy of the determined position over time, the determined position may be regularly reset based on absolute position information provided by the absolute position sensor.

The hoistway components also may be sensors attached to a wall of the hoistway which are configured for detecting the actual position of the elevator car.

In the following an exemplary embodiment of the invention is described with reference to the enclosed figures.

FIG. 1 schematically depicts an elevator system comprising an elevator safety system according to an exemplary embodiment of the invention.

Figure 1:
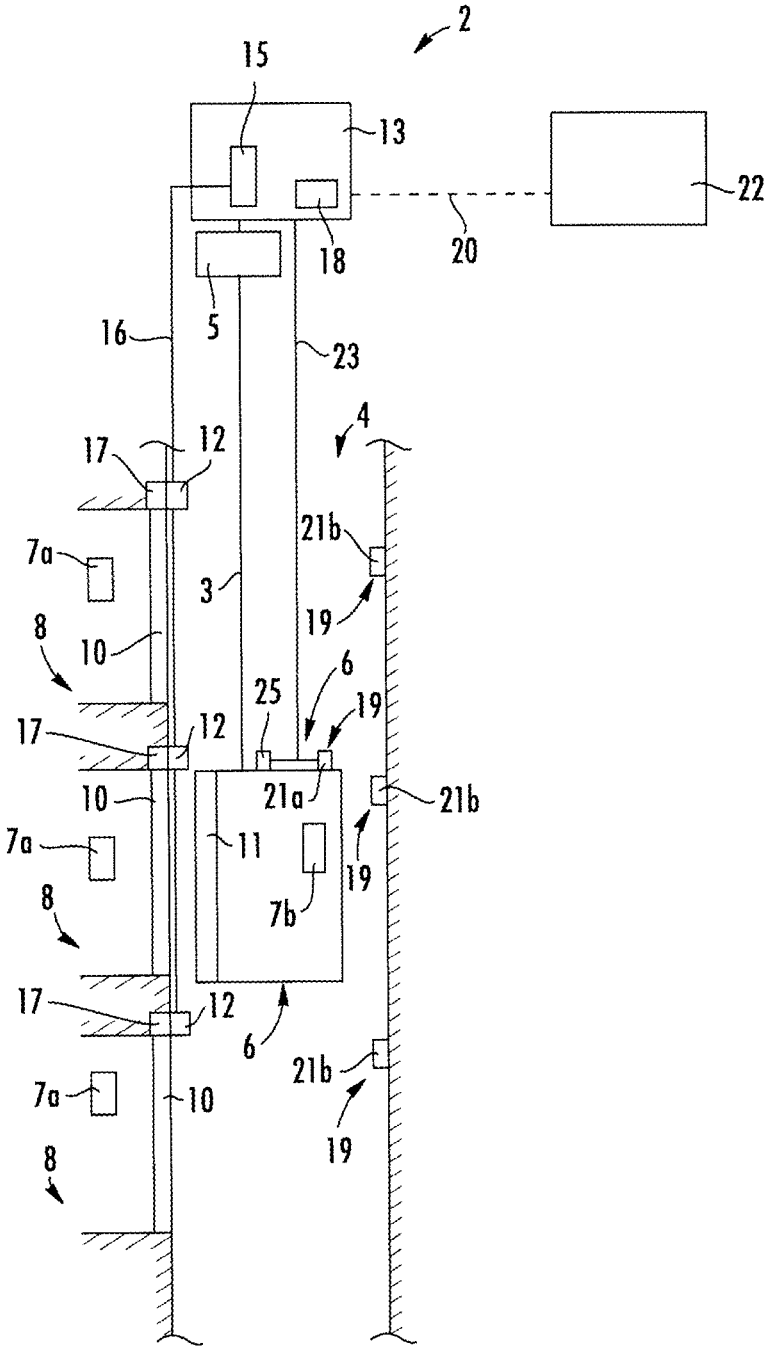

FIG. 1 schematically depicts an elevator system 2 comprising an elevator safety system according to an exemplary embodiment of the invention.

The elevator system 2 comprises an elevator car 6 which is movably suspended within a hoistway 4 extending between a plurality of landings 8 located on different floors.

The elevator car 6 is movably suspended by means of a tension member 3. The tension member 3, for example a rope or belt, is connected to a drive unit 5, which is configured for driving the tension member 3 in order to move the elevator car 6 along the height of the hoistway 4 between the plurality of landings 8.

Each landing 8 is provided with an elevator hoistway door (landing door) 10, and the elevator car 6 is provided with a corresponding elevator car door 11 allowing passengers to transfer between a landing 8 and the interior of the elevator car 6 when the elevator car 6 is positioned at the respective landing 8.

The exemplary embodiment of the elevator system 2 shown in FIG. 1 employs a 1:1 roping for suspending the elevator car 6. The skilled person, however, easily understands that the type of the roping is not essential for the invention and that different kinds of roping, e.g. a 2:1 roping, may be used as well. The elevator system 2 may further include a counterweight (not shown) moving concurrently and in opposite direction with respect to the elevator car 6. Alternatively, the elevator system 2 may be an elevator system 2 without a counterweight, as it is shown in FIG. 1. The drive unit 5 may be any form of drive used in the art, e.g. a traction drive, a hydraulic drive or a linear drive. The elevator system 2 may have a machine room or may be a machine room-less elevator system. The elevator system 2 may use a tension member 3, as it is shown in FIG. 1, or it may be an elevator system without a tension member 3, comprising e.g. a hydraulic drive or a linear drive (not shown).

The drive unit 5 is controlled by an elevator control unit 13 for moving the elevator car 6 along the hoistway 4 between the different landings 8.

Input to the elevator control unit 13 may be provided via landing control panels 7*a*, which are provided on each landing 8 close to the elevator hoistway doors 10, and/or via a car operation panel 7*b* provided inside the elevator car 6.

The landing control panels 7*a* and the car operation panel 7*b* may be connected to the elevator control unit 13 by means of electrical lines, which are not shown in FIG. 1, in particular by an electric bus, e.g. a field bus such as a CAN bus, or by means of wireless data connections.

A door safety unit (door safety node) 12 is provided at every landing 8. At least one door sensor 17, in particular an elevator hoistway door sensor 17, is associated and electrically connected with each of the door safety units 12. The door sensor 17 is configured for monitoring the operation, in particular the opening and closing, of an associated elevator hoistway door 10.

The door safety units 12 are provided as bus nodes connected to a common communication bus 16 extending along the hoistway 4 between the plurality of landings 8. The communication bus 16 uses a predefined data protocol for communicating instructions between the door safety units 12 (bus nodes) connected to the communication bus 16. A number of different communication buses 16 and related data protocols are used in the art and known to the skilled person.

The communication bus 16, which in particular may be a field bus, e.g. CAN bus, is configured to allow communication between each of the plurality of door safety units 12 and the elevator control unit 13, in particular an elevator safety unit 15 being part of the elevator control unit 13. The combination of the communication bus 16 with the door safety units 12 provides a digital implementation of a safety chain.

Optionally, the communication bus 16 may be configured for additionally transmitting information between the landing control panels 7*a* and the elevator control unit 13. Alternatively, a separate bus (not shown) may be used for transmitting information between the landing control panels 7*a* and the elevator control unit 13.

In order to determine the current position of the elevator car 6, the elevator system 2 is provided with at least one position sensor 19 configured for detecting the current position (height) of the elevator car 6 within the hoistway 4.

The position sensor 19 is connected with the control unit 13 via a signal line 23 or via a wireless connection configured for transmitting the detected position of the elevator car 6 to the control unit 13. The signal line 23 may be part of the communication bus 16 or a separate bus system.

The position sensor 19 may comprise a car component 21*a* attached to the elevator car 6 and/or at least one hoistway component 21*b* located within the hoistway 4. The at least one hoistway component 21*b* in particular may be attached to a wall of the hoistway 4. The car component 21*a* and the at least one hoistway component 21*b* may be configured for interacting and/or communicating with each other in order to determine the current position of the elevator car 6. Alternatively, the car component 21*a* and/or the at least one hoistway component 21*b* may be configured for determining the current position of the elevator car 6 autonomously, i.e. without interacting with another component 21*a*, 21*b*.

The position sensor 19 may be an absolute position sensor 19 or an incremental position sensor 19 which is configured for detecting and summing up relative movements of the elevator car 6 in order to determine the absolute position of the elevator car 6 within the hoistway 4.

The position sensor 19 also may be a combination of an absolute position sensor 19 and an incremental position sensor 19. With such a combination the current position of the elevator car 6 may be continuously determined by the incremental position sensor 19. For maintaining the accuracy of the determined position over time, the determined position may be regularly reset based on absolute position information provided by the absolute position sensor 19.

Each of the door safety units 12 may be configured for sending an alarm signal via the communication bus 16 to the control unit 13 in case an unusual status of an elevator hoistway door 10 is detected by the associated elevator hoistway door sensor 17. Said unusual status in particular may include an elevator hoistway door 10 being open or not properly closed.

The elevator control unit 13 repeatedly polls the door safety units 12 in order to ensure that all door safety units 12 are properly operating and none of the elevator hoistway doors 10 has been opened without the elevator car 6 being positioned at the associated landing 8.

In case at least one of the door safety units 12 sends an alarm signal indicating an unusual status of an elevator hoistway door 10, e.g. that a hoistway door 10 which should be closed is open or not properly closed, the elevator control unit 13 stops any further movement of the elevator car 6.

The information provided by the at least one door safety unit 12 may include further information, in particular information which allows identifying the door safety unit 12 sending the alarm signal. This allows to quickly localize the detected problem.

Optionally, the information provided by the at least one door safety unit 12 may be additionally sent by a communication unit 18, which is provided within or connected with the elevator control unit 13, via an external communication line 20 to an external service center 22.

The external service center 22 may instruct a mechanic to visit the elevator system 2 in order to solve the detected problem. Based on the information provided by the communication unit 18, the mechanic may take the tools and/or spare parts needed for solving the problem with him in order to facilitate and speed up the repair process.

The external communication line 20 may include a conventional telephone line or a digital line such as ISDN or DSL. It further may include wireless communication including WLAN, GMS, UMTS, LTE, Bluetooth® etc.

Regularly polling the door safety unit 12 may result in much traffic on the communication bus 16, in particular in large buildings with long hoistways 4 comprising a large number of landings 8. A high performance communication bus 16, which is capable to handle such heavy traffic, is expensive. It therefore is desirable to reduce the traffic on the communication bus 16.

Figure 2:
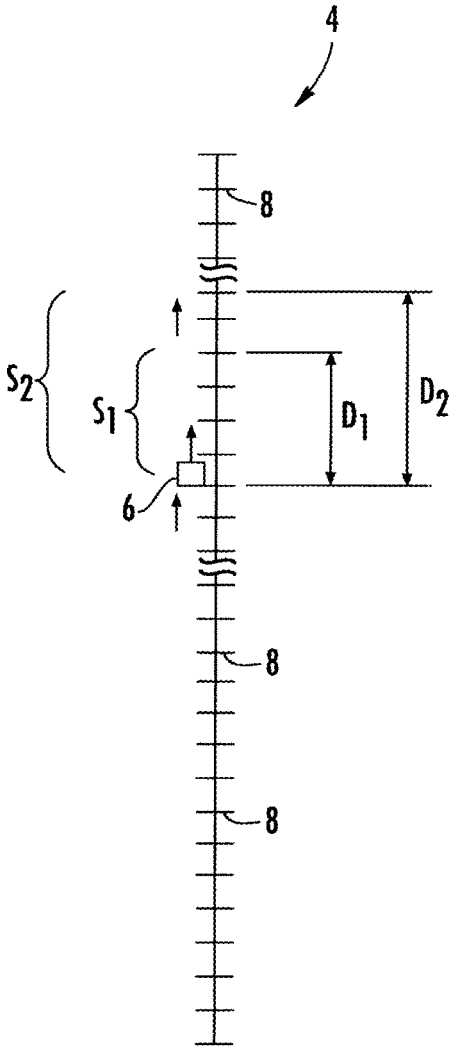
FIG. 2 shows a schematic view of an elevator car moving upwards.
Figure 3:
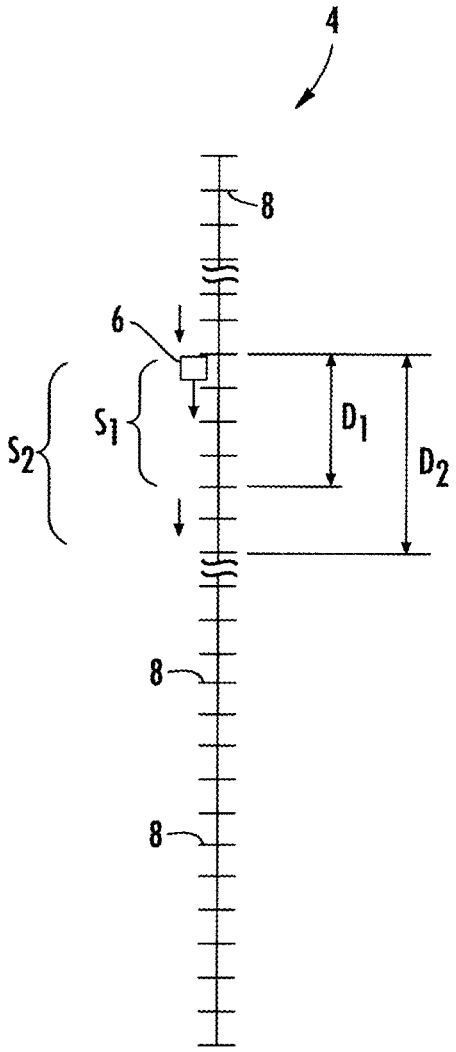
FIG. 3 shows a schematic view of an elevator car moving downwards.

Long hoistways 4 extending between large numbers of landings 8 are schematically illustrated in FIGS. 2 and 3. For reasons of clarity only some of the landings 8 are provided with reference signs in FIGS. 2 and 3.

FIG. 2 shows a schematic view of an elevator car 6 moving upwards within the hoistway 4, and FIG. 3 shows a schematic view of an elevator car 6 moving downwards within the hoistway 4.

According to an exemplary embodiment of the invention, the control unit 13 (not shown in FIGS. 2 and 3) is configured for polling only a subset S1, S2 of all door safety units 12, in particular a subset S1, S2 including only those door safety units 12 which are located within a predetermined distance D1, D2 from the current position of the elevator car 6 as determined by the at least one position sensor 19. (The position sensor 19 is not shown in FIGS. 2 and 3.)

The control unit 13 in particular may be configured for polling only a subset S1, S2 of door safety units 12 located within a predetermined distance D1, D2 of one, two, three, four, five or even more landings 8 below and/or above the current position of the elevator car 6.

The predetermined distance D1, D2 may be set based on the (maximum) speed of the elevator car 6. I.e. in a high speed elevator system 2, in which the elevator car 6 is configured to move with a high speed, a relatively larger subset S2 of door safety units 12 (not shown in FIGS. 2 and 3) above and/or below the elevator car 6 are polled. A smaller subset S1 of door safety units 12 above and/or below the elevator car 6 may be polled in an elevator system 2, in which the elevator car 6 is configured to move with a lower speed.

The predetermined distance D1, D2 may be set once when the elevator system 2 is installed.

Alternatively, the predetermined distance D1, D2 may be adjusted dynamically based on the current speed of the elevator car 6. The current speed of the elevator car 6 may be determined from the positional information provided by the at least one positional sensor 19, or by an additional speed sensor 25 attached to the elevator car 6 (see FIG. 1). In such a configuration, a larger subset S2 of door safety units 12 above and/or below the elevator car 6 is polled in case of a relatively high speed of the elevator car 6, and a smaller subset S1 of door safety units 12 above and/or below the elevator car 6 is polled in case of a relatively low speed of the elevator car 6.

The at least one positional sensor 19 and/or the speed sensor 25 may be configured for additionally determining the direction of movement of the elevator car 6. Alternatively, the direction of movement of the elevator car 6 may be known from the direction in which the drive 5 is operated. As the elevator hoistway doors 10 ahead ("upstream") of the elevator car 6 are more crucial for the safety of the elevator system 2 than the elevator hoistway doors 10 located behind ("downstream" of) the elevator car 6, the control unit 13 may poll different numbers of door safety units 12 ahead and behind the elevator car 6, respectively. This reduces the traffic on the communication bus 16 even further without considerably deteriorating the safety of the elevator system 2.

The control unit 13, for example, may poll two, three, four, or five door safety units 12 ahead of the elevator car 6 and only one or even no door safety unit 12 behind the elevator car 6. The number of door safety units 12 polled ahead of the elevator car 6 may be set depending on the speed of the elevator car 6, as it has been described before.

The door safety units 12 included in the selected subset S1, S2 may be polled periodically in intervals between 33 ms and 100 ms, in particular at intervals of 50 ms, i.e. with a polling frequency f of 10 Hz to 30 Hz, in particular with a polling frequency f of 20 Hz.

As the hoistway doors 10 close to the current position of the elevator car 6 are more crucial for the safety of the elevator system 2 than the hoistway doors 10, which are more distant from the current position of the elevator car 6, the control unit 13 may be configured for polling a first subset S1 of door safety units 12, which are located within a first distance D1 from the current position of the elevator car 6 with a first frequency f1, and the control unit 13 may be configured for polling a second subset S2 of door safety units 12, which are located within a second distance D2>D1 from the current position of the elevator car 6 with a second frequency f2, wherein the first frequency f1 is larger than the second frequency f2 (f1>f2). In other words, the door safety units 12 in the first subset S1 are polled more frequently than the door safety units 12 in the second subset S2. Polling the door safety units 12 in the second subset S2 less frequently reduces the traffic on the communication bus 16 without considerably deteriorating the safety of the elevator system 2.

By polling only door safety units 12 included in at least one subset S1, S2, i.e. by polling only door safety units 12 located within a predetermined distance D1, D2 from the current position of the elevator car 6, and/or by polling door safety units 12 which are not included in any subset S1, S2 less frequently, the traffic on the communication bus 16 is considerably reduced without deteriorating the safety of the elevator system 2.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention not be limited to the particular embodiments disclosed, but that the invention include all embodiments falling within the scope of the claims.

REFERENCES

2 elevator system
3 tension member
4 hoistway
5 drive
6 elevator car
7*a* landing control panel
7*b* car operation panel
8 landing
10 elevator hoistway door
11 elevator car door
12 door safety unit

13 elevator control unit
15 elevator safety unit
16 communication bus
17 (landing) door sensor
18 communication unit
19 position sensor
20 external communication line
21*a* car component
21*b* hoistway component
22 external service center
23 signal line
25 speed sensor
D1 first distance
D2 second distance
S1 first subset of door safety units
S2 second subset of door safety units

What is claimed is:

1. Elevator safety system comprising:

a plurality of door safety units (12), each door safety unit (12) assigned to an elevator hoistway door (10) and configured for monitoring a condition of the assigned elevator hoistway door (10);

a communication bus (16) connecting the plurality of door safety units (12);

a control unit (13) connected to the communication bus (16) for allowing communication between the plurality of door safety units (12) and the control unit (13); and at least one position sensor (19) configured for providing information about the current position of an elevator car (6) within a hoistway (4);

wherein the control unit (13) is configured for polling door safety units (12) included in a subset (S1, S2) of the door safety units (12) which are located within a predetermined distance (D1, D2) from the current position of the elevator car (6); and for polling door safety units (12) which are not included in said subset (S1, S2) less frequently or not at all.

2. Elevator safety system according to claim 1, wherein the control unit (13) is configured for periodically polling the door safety units (12) included in the subset (S1, S2) of door safety units (12) with a frequency (f) of 10 Hz to 30 Hz.

3. Elevator safety system according to claim 1, wherein the control unit (13) is configured for polling the door safety units (12) included in the subset (S1, S2) of door safety units (12) exclusively.

4. Elevator safety system according to claim 1, wherein the control unit (13) is configured for polling the door safety units (12) not included in the subset (S1, S2) less frequently than the door safety units (12) included in the subset (S1, S2) of door safety units (12).

5. Elevator safety system according to claim 4, wherein the control unit (13) is configured for polling the door safety units (12) included in the subset (S1, S2) of door safety units (12) with a first frequency (f1), and wherein the control unit (13) is configured for polling the door safety units (12) not included in the subset (S1, S2) with a second frequency (f2) which is lower than the first frequency (f1).

6. Elevator safety system according to claim 1, wherein the control unit (13) is configured for polling door safety units (12) included in a first subset (S1) located within a first predetermined distance (D1) from the current position of the elevator car (6) more frequently than door safety units (12) included in a second subset (S2) located between the first predetermined distance (D1) and a second predetermined distance (D2) larger than the first predetermined distance (D1) from the current position of the elevator car (6).

7. Elevator safety system according to claim 1 wherein the predetermined distance (D1, D2) is selected such as to include a predetermined number of landings (8) ahead of or behind the current position of the elevator car (6).

8. Elevator safety system according to claim 1, further comprising a sensor (19, 25) configured for determining a direction of movement of the elevator car (6); wherein the control unit (13) is configured for polling more door safety units (12) located ahead of the moving elevator car (6) than door safety units (12) located behind the moving elevator car (6).

9. Elevator safety system according to claim 1, wherein the predetermined distance (D1, D2) depends on the speed of the elevator car (6), wherein the elevator system (12) comprises a speed sensor (25) configured for detecting the speed of the elevator car (6).

10. Elevator safety system according to claim 1, wherein the door safety units (12) are configured for sending an alarm signal via the communication bus (16) in case a predetermined event is detected.

11. Elevator safety system according to claim 1, wherein the communication bus (16) is a field bus.

12. Elevator system (12) comprising:

a hoistway (4) extending between a plurality of landings (8) and having a plurality of elevator hoistway doors (10);

an elevator car (6) configured for moving along the hoistway (4) between the plurality of landings (8); and an elevator safety system according to claim 1.

13. Elevator system (12) according to claim 12, wherein the control unit (13) is configured for stopping any movement of the elevator car (6) in case an alarm signal is transmitted via the communication bus (16) or a polled door safety unit (12) does not respond in due time.

14. Elevator system (12) according to claim 12, wherein the position sensor (19) comprises a car component (21*a*) attached to the elevator car (6) or a hoistway component (21*b*) located within the hoistway (4).

15. Method of operating an elevator safety system according to claim 1, wherein the method includes polling door safety units (12) included in a subset (S1, S2) of the door safety units (12) which are located within a predetermined distance (D1, D2) from the current position of the elevator car (6) and polling the door safety units (12) which are not included in said subset less frequently or not at all.

16. Elevator safety system according to claim 6, wherein the control unit (13) is configured for not polling door safety units (12) not included in any of the subsets (S1, S2).

17. Elevator safety system according to claim 1 wherein the predetermined distance (D1, D2) is selected such as to include a predetermined number of landings (8) ahead of and behind the current position of the elevator car (6).

18. Elevator system (12) according to claim 12, wherein the control unit (13) is configured for stopping any movement of the elevator car (6) in case an alarm signal is transmitted via the communication bus (16) and a polled door safety unit (12) does not respond in due time.

* * * * *